United States Patent [19]

Lindgren

[11] 3,990,948

[45] Nov. 9, 1976

[54] APPARATUS FOR CLEANING THE BOTTOM SURFACE OF A COKE OVEN DOOR PLUG

[75] Inventor: Carl G. Lindgren, Pittsburgh, Pa.

[73] Assignee: Koppers Company, Inc., Pittsburgh, Pa.

[22] Filed: Feb. 11, 1975

[21] Appl. No.: 549,077

[52] U.S. Cl. ..... 202/241; 15/236 C

[51] Int. Cl.[2] ..... C10B 43/00; A47L 13/02

[58] Field of Search ..... 202/241; 15/93, 236

[56] References Cited

UNITED STATES PATENTS

| | | | |
|---|---|---|---|
| 3,621,506 | 11/1971 | Armstrong | 202/241 |
| 3,696,004 | 10/1972 | McCullough | 202/241 |
| 3,741,806 | 6/1973 | Stanke | 202/241 |

FOREIGN PATENTS OR APPLICATIONS

| | | | |
|---|---|---|---|
| 234,003 | 6/1959 | Australia | 202/241 |

*Primary Examiner*—Jack Sofer

*Attorney, Agent, or Firm*—Sherman H. Barber; Olin E. Williams; Oscar B. Brumback

[57] ABSTRACT

A cleaner head is pivotally mounted to a shaft carried by an actuating arm that is so powered that, as the actuating arm pivots about an axis, the cleaner head, which is resiliently biased, engages and cleans the bottom surface of a coke oven door plug or lining.

9 Claims, 5 Drawing Figures

APPARATUS FOR CLEANING THE BOTTOM SURFACE OF A COKE OVEN DOOR PLUG

BACKGROUND OF THE INVENTION

In the past, the build-up of carbon and tar deposits on the bottom surface of a coke oven door plug or lining that is parallel to the oven floor, has prevented the coke oven door from seating properly at the oven, which has prevented the coke oven door from being latched securely. Heretofore, it has been necessary to manually clean this bottom surface periodically in order to maintain sufficient clearance between it and the oven floor so that the door can be latched securely.

BRIEF SUMMARY OF THE INVENTION

Apparatus adapted for use in cleaning the bottom surface of the lining of a coke oven door includes a cleaning tool pivotally supported on a shaft that is mounted to an actuating arm. The arm is movable by powered means so as to bring the cleaning tool into cleaning contact with the bottom surface of the lining. The cleaning tool is resiliently supported on the shaft and a fluid-actuated mechanism moves the arm.

For a further understanding of the invention and for features and advantages thereof, reference may be made to the following description and the drawing which illustrates a preferred embodiment of equipment in accordance with the invention.

DETAILED DESCRIPTION

Figure 1:
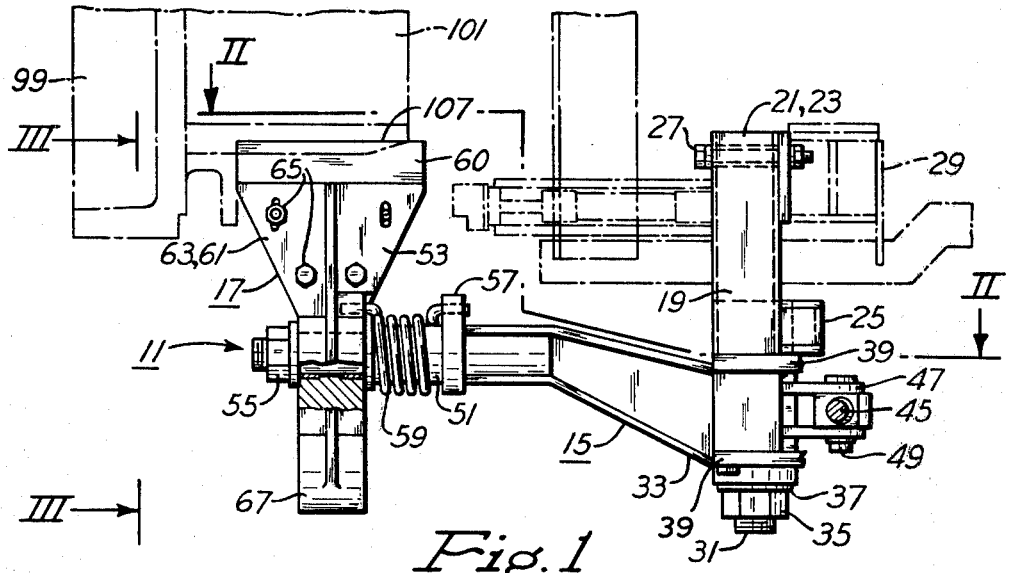
FIG. 1 is a schematic view of one embodiment of apparatus in accordance with the invention.

Referring to FIG. 1, one embodiment of apparatus 11 in accordance with the invention for cleaning the bottom surface of a coke oven door plug 13 or lining includes: a main support structure 15 and a cleaner head 17 pivotally mounted to the support structure 15.

The main support structure 15 comprises a yoke 19 that has two upright support members 21, 23 that are connected together at one end by a horizontal transverse member 25. Each upright support member 21 and 23 is suitably secured, as by fasteners 27, to a portion of a conventional horizontal cleaning tool frame 29.

The horizontal transverse member 25 carries a dependent rod 31, having a bottom end which is threaded and which supports an arm 33. The arm 33 is maintained in place on the rod 31 by a nut 35 and lock washer 37 of conventional kind.

The upright support member 23 carries an outwardly protruding bracket 39 which is the support for a cylinder-piston assembly 41 that is pivotally mounted, as at 43, to the bracket 39. A piston rod 45 connects the assembly 41 to a clevis 47 fixed to the arm 33 by means of a pin 49, and the cylinder-piston 41 and rod 45 provide one apparatus for pivoting the arm 33 about the vertical axis of the rod 31.

The cleaner head 17 is pivotably carried on a support shaft 51 that is fixedly mounted to the outer end of the pivotable arm 33. The outer end of the shaft 51 carries a cleaning tool holder 53 which is maintained in its pivotable position by a nut 55 threaded onto the end of the shaft 51.

At the end of the shaft 51, where it connects to the arm 33, there is provided a stop plate 57 which is fixed to the shaft 51 and which has a hole through it. One end of a torsion spring 59, coiled about the shaft 51, resides in the hole, and the other end of the torsion spring 59 resides in a corresponding hole in the cleaning tool holder 53. If preferred, two concentric torsion springs may be employed instead of only one spring.

The cleaning tool holder 53 includes a generally trapezoidal shaped planar blade 60 disposed between side members 61, 63 through which one or more fasteners 65 extend that, when tightened, keep and hold the blade 60 in position in the tool holder 53.

Figure 3:
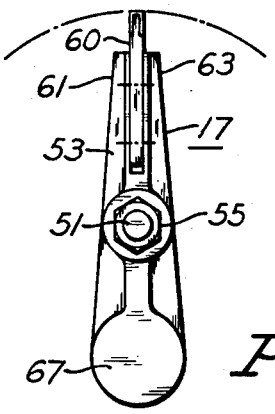
FIG. 3 is a view along line III — III of FIG. 1.

The cleaner head 17 is provided with an enlarged lower portion 67, as shown in FIG. 3, that serves as a counterweight to the blade 60. Thereby, whenever the blade 60 is not engaged in cleaning operations, it returns to a vertical position, as suggested in FIGS. 1 and 3.

Figure 2:
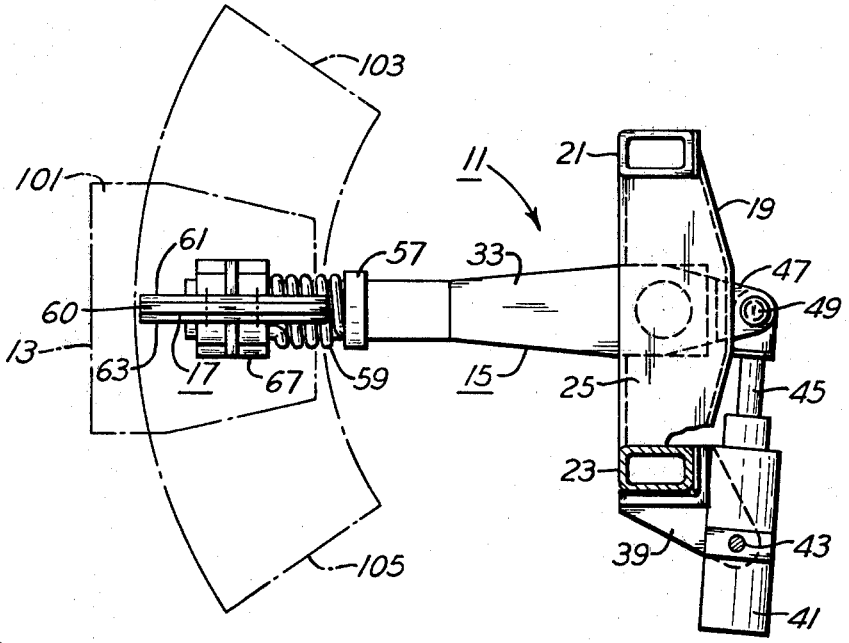
FIG. 2 is a plan view of the apparatus of FIG. 1.
Figure 4:
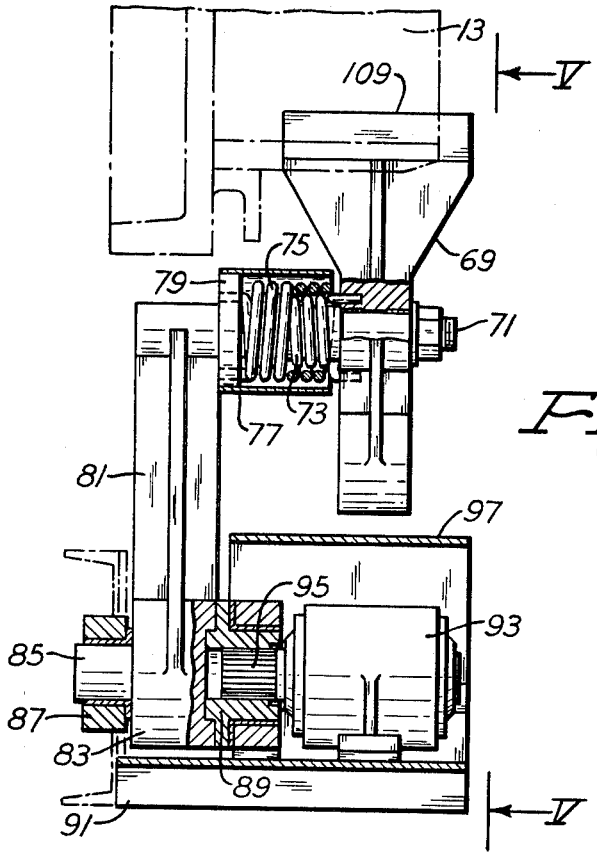
FIG. 4 is a schematic view of a second embodiment of apparatus in accordance with the invention.
Figure 5:
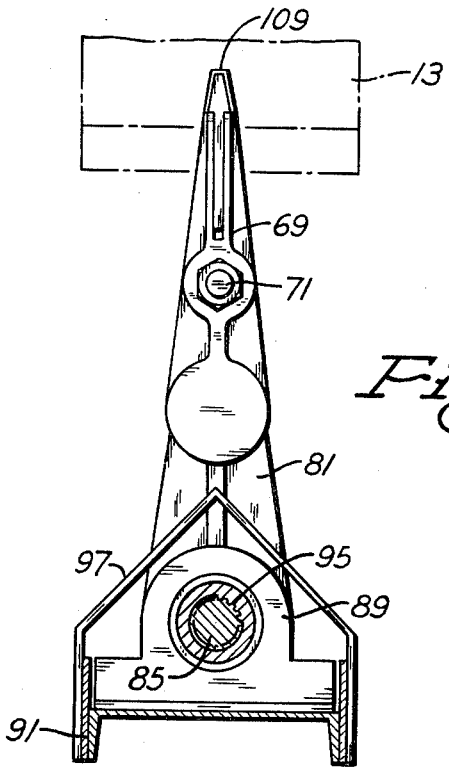
FIG. 5 is a view along line V — V of FIG. 4.

Referring now to FIGS. 4 and 5, another embodiment of the invention is shown. In this embodiment, a cleaner head 69, which is similar to the cleaner head 17 of FIGS. 1–3, is pivotally mounted to a shaft 71. There are two concentric torsion springs 73, 75 surrounding the shaft 71, instead of one torsion spring 59, as shown in FIGS. 1 and 2, and the concentric torsion springs 73, 75 are surrounded with a cylindrical shield 77.

The torsion springs 73, 75 terminate at one end each in the cleaner head 69 and at each other end in a stop plate 79, like stop plate 57, fastened to the shaft 71.

The shaft 71 is fixed in the free end portion of an actuating arm 81 that is also fixed to a hub 83. The hub 83 is secured to a shaft 85 that is journaled in bearings 87, 89 mounted to a base 91.

The shaft 85 is coupled to a hydraulic actuator 93, used to rotate the shaft 85, or it may be coupled to an electric motor and speed reducer (not shown). As suggested in FIGS. 4 and 5, the output shaft of the hydraulic actuator 93 is splined with shaft 85, as at 95, but any other suitable type of shaft connection may be employed if preferred. The hydraulic actuator 93 is surrounded with a suitable housing 97 to protect it, as suggested in FIGS. 4 and 5.

Before operating the device 11 of FIGS. 1–3, the coke oven doors are removed from the oven and are placed in positions to be cleaned in the usual way. In FIG. 1, a portion of coke oven door 99 is shown in such a position. The coke oven door 99 carries a conventional refractory door plug or lining 101, and it is the bottom surface of this door plug that is to be cleaned by the apparatus of the invention. After placing the door in position, the door cleaner tool frame 29 is lowered to the position shown in FIG. 1. Then, the cleaner head 17 is pivoted from a stowed position, not in contact with the door plug 101, to a position such that, when the arm 33 pivots through the pattern shown in FIG. 2, extending from radial line 103 to radial line 105, the cleaner head coacts with bottom surface of the door plug 101 in a scraping and cleaning action.

The cleaning blade 60 is shown in FIG. 1 as being in the upright position, which it naturally assumes under the influence of the counterweight 67, as mentioned previously. The top edge 107 of the blade 60 appears to be slightly above the bottom surface of the door plug or lining 13. However, when the arm 33 commences its sweep, starting from line 103, the blade 60 contacts the bottom surface of the door plug or lining 13 and pivots about the axis of the shaft 51. The blade acts against the plug with a force corresponding to the force exerted by the torsion spring 59.

When the arm 33 sweeps back, starting from line 105, the blade 60 again pivots against the plug and the force of a second concentrically wound spring if used, as mentioned above, would exert a scraping force against the bottom of the door plug or lining.

The operation of the apparatus of FIGS. 4 and 5 is somewhat different from that described for the apparatus of FIGS. 1–3. The arm 81 rotates about the axis of shaft 85 and the cleaner head 69, which is shown with its tops edge 109 above the bottom surface of the door plug pivots about the axis of shaft 71 against the force of the torsion springs 73, 75 and thereby applies a scraping force against the bottom of the door plug 13. Because the apparatus of FIGS. 4 and 5 has two torsion springs 73, 75, the cleaning head 69 effectively cleans the bottom surface of the door plug in both directions.

From the foregoing description of one embodiment of the invention, those skilled in the art should recognize many important features and advantages of it, among which the following are particularly significant:

That the apparatus of the invention is operable automatically by remote control after a coke oven door is retracted and is turned to the cleaning position;

That the cleaner head portion of the invention can be readily and quickly removed and replaced when it becomes desirable or necessary to do so; and That by using two concentric torsion springs with each cleaner head, it cleans effectively in both directions of movement.

Although the invention has been described herein with a certain degree of particularity it is understood that the present disclosure has been made only as an example and that the scope of the invention is defined by what is hereinafter claimed.

What is claimed is:

1. Apparatus for cleaning the bottom surface of the lining of a coke oven door including:

a. a cleaning tool pivotally mounted to b. a horizontal shaft supporting said cleaning tool;

c. an arm carrying said horizontal shaft and said cleaning tool; and d. means for horizontally oscillating said arm and cleaning tool arcuately beneath said door lining whereby said tool coacts with and cleans said bottom surface.

2. The apparatus of claim 1 wherein:

a. said cleaning tool includes a tool holder that is pivotally mounted to said shaft; and b. a blade that is removably mounted to said holder.

3. The apparatus of claim 1 wherein:

a. said means for moving said arm includes a fluid-actuated mechanism.

4. The apparatus of claim 1 including:

a. means resiliently mounting said tool to said shaft.

5. The apparatus of claim 4 wherein:

a. said resilient means includes at least one spring surrounding said shaft with the ends of said spring supported anchored in said arm and said tool, with said spring being capable thereby of exerting a torsional force to said tool.

6. Apparatus for cleaning the bottom surface of the lining or plug of a coke oven door including:

a. a cleaning tool comprising a blade member removably mounted to a holder pivotally mounted to b. a horizontal shaft supporting said holder and blade;

c. an arm carrying said horizontal shaft;

d. means resiliently biasing said holder to said shaft; and e. fluid actuated means for horizontally oscillating said arm and cleaning tool arcuately beneath said door lining and about a vertical axis whereby said blade contacts and cleans said bottom surface.

7. The apparatus of claim 6 wherein:

a. said means resiliently biasing said holder is a spring.

8. The apparatus of claim 6 wherein:

a. said resilient means includes a pair of concentric springs surrounding said shaft with the ends of each spring anchored in said holder and said shaft.

9. The apparatus of claim 6 including:

a. means for so positioning said fluid actuated means that when said arm oscillates about said axis, said blade cleaningly coacts with said surface.

* * * * *